United States Patent [19]

Gruodis et al.

[11] 3,937,456

[45] Feb. 10, 1976

[54] ARTICLE STACKING APPARATUS

[75] Inventors: Romualdas K. Gruodis, Mt. Airy, Md.; Eugene D. Milbradt, Annandale, Va.

[73] Assignee: Fairchild Industries, Inc., Germantown, Md.

[22] Filed: Sept. 26, 1974

[21] Appl. No.: 509,724

[52] U.S. Cl. ..... 271/64; 271/184; 271/217; 193/8; 214/6 D

[51] Int. Cl.[2] ..... B65H 29/26; B65H 31/08

[58] Field of Search ..... 271/63, 64, 174, 182, 184, 271/185, 207, 217; 193/3, 3 A, 8, 33, 34; 214/6 D, 6 H

[56] References Cited

UNITED STATES PATENTS

| | | | |
|---|---|---|---|
| 1,331,273 | 2/1920 | Marble | 214/6 D |
| 1,565,840 | 12/1925 | Wise | 271/64 |
| 2,124,858 | 7/1938 | Marchand | 271/64 |
| 2,271,187 | 1/1942 | Fortescue et al. | 214/6 D |
| 2,742,994 | 4/1956 | Towner | 193/34 |
| 2,770,192 | 11/1956 | Mitchell et al. | 271/207 |
| 2,944,685 | 7/1960 | Nicolazzi | 214/6 H |

*Primary Examiner*—Evon C. Blunk
*Assistant Examiner*—Robert Saifer
*Attorney, Agent, or Firm*—Michael W. York

[57] ABSTRACT

An article stacking apparatus for stacking flat randomly shaped articles and the like including a movable article transporter, inclined slides located beneath the transporter, and containers having three sides and an open top located at the lower end of the slides. The transporter, slides and the containers are uniquely configured to minimize the impact velocity of the article with the slide and to permit the random articles to be placed in a stack that has two flush sides. Elevators are provided for adjusting the height of the containers in accordance with the height of the stack, and sensors are provided which detect the height of the stack and feed appropriate signals to an elevator control circuit which controls the elevators.

4 Claims, 6 Drawing Figures

14
12
13
11
10
16
15
39
41
48
LIGHT SOURCE
20
43
39
38
38
17
$\gamma + \frac{\pi}{2}$
48
46
42
17
OVERRIDE SWITCH
24
21
UPPER ELEVATION LIMIT SWITCH
47
40
23
TRAY FULL INDICATOR
53
23
40
19
18
22
44
41
STACK HEIGHT SENSOR
LOWER ELEVATION LIMIT SWITCH
18
ELEVATOR CONTROL CIRCUIT
50
49
52
51

ARTICLE STACKING APPARATUS

BACKGROUND OF THE INVENTION

Automatic article stacking apparatus have been typically employed in the past to sort such articles as letter mail. One such apparatus is known by the name "Letter Sorting Machine" (LSM). In the letter sorting machine, the letters are individually transported in an upright or vertical attitude within separate compartments in a carrier. The carrier compartment configuration resembles that of a file drawer. It contains several vertical separators located on a uniform pitch of about two inches. Each compartment of the carrier has a hinged floor which is capable of independent operation as a trap door. One compartment will contain only one piece of mail. The individual carriers are pulled or caused to be moved serially in a continuous train in such a manner that the direction of motion is substantially normal to the principal plane of the compartments. The path of the carrier is such that it takes it over a drop point corresponding to each destination for certain letters. At a predetermined time, a control system causes a programmed release of the trap door of a compartment and the associated piece of mail.

After its release through the compartment trap door the mail piece accelerates in free fall while maintaining the forward velocity imparted to it by the carrier. This mail piece, which has both a forward and downward velocity component, then impacts with a short curved slide and immediately descends down the slide into a small receiving compartment with a sloped floor that is provided for accumulating and stacking successively arriving pieces of mail. The arriving piece of mail is initially arrested by contact with that wall of the receiving compartment which is opposite the end of the chute. After the mail piece contacts the wall of the compartment, it drops on top of whatever mail has previously accumulated in the compartment. Commonly, the floor of the compartment is located on a slope which is directly downward and away from the end of the chute and as a consequence, this causes the leading edge of successive pieces of mail to remain in contact with the down stream portion of the wall to thereby obtain a flush condition on one face of the stack.

In a typical case, the stack will accumulate up to a level which is slightly below the end of the chute and at this point the stack will block the beam of a photosensor. The photosensor will then cause a conventional alert signal to be generated to alert personnel in the area to remove the full stack of mail. Removal of the full stack of mail is usually easily accomplished by grasping the stack in one or both hands since the stack height is usually manageable and the mail usually consists of relatively uniform pieces which are less then eleven by six inches in size.

There are a number of deficiencies with this previously described prior art system that is in current use. In this prior art system there is an unnecessarily severe impact between the article and the slide, involving not only the inevitable vertical velocity component due to the gravity induced transfer but also a forward or horizontal velocity component imparted by the transport carrier motion. Furthermore, in this prior art apparatus after the articles have been stacked the edges of the articles are flush only along one side of the stack rather than two sides. Consequently, in order for letter mail thus accumulated to be subsequently separated one piece at a time from the top of the stack by automated means typically used in mail processing systems, the mail must be "edged", that is, manually manipulated or introduced into a vibrating environment so as to achieve a flush edge condition on two sides of the stack. This step represents additional expense in the processing operation.

Furthermore, since the edges of the articles in this prior art apparatus are only flush on one side of the stack, this places some definite limitation on the range of random size articles that can feasibly be stacked without very troublesome procedures that will be required for a subsequent edging operation. For instance, when the article dimensions are less than half the corresponding compartment dimensions a succession of such articles may initially fail to stack one upon the top of the other but rather will fall side by side. If this occurs, subsequent vibratory efforts to edge such articles in a stack exhibiting such a condition will have indifferent success without the reconstruction of the stack piece by piece. Furthermore, should any of these articles be loose-leaved such as magazines or newspapers or the like, vibratory edging efforts are not only likely to fail but in fact may lead to damage of the leaves of the articles.

In addition, since the subject prior art apparatus provides a resulting stack which has the edges of the articles flush on only one side, this places an inherent limitation on the randomness of the article size that can be accommodated in the same stack as well as a limitation on the height of the stack that can be handled, without the resulting stack instability leading to an unacceptable risk of deshevelment, collapse and article damage.

The article stacking apparatus of the present invention overcomes these disadvantages associated with prior art systems and provides an article stacking apparatus that has reduced article impact velocity and which results in a stack of articles which has two flush edges without any need for additional edging operations.

BRIEF DESCRIPTION OF THE INVENTION

This invention relates to article stacking apparatus and more particularly to article stacking apparatus which passively stack the articles.

It is an object of the present invention to provide an article stacking apparatus which reduces the possibility of damage to the article which is to be stacked.

It is an object of the present invention to provide an article stacking apparatus which reduces the impact velocity of the article which is to be stacked.

It is an object of the present invention to provide an article stacking apparatus which is capable of simultaneously handling a population of relatively flat articles of varying sizes.

It is an object of the present invention to provide an article stacking apparatus which is capable of stacking articles such as looseleaf documents, magazines and the like.

It is an object of the present invention to provide an article stacking apparatus which is passive in nature and has few moving parts.

It is also an object of the present invention to provide an article stacking apparatus which reduces the likelihood for the need for edging of the stack.

It is also an object of the present invention to provide an article stacking apparatus which provides a stack of articles in which the edges of the articles along two faces of the stack are substantially flush.

It is also an object of the present invention to provide an article stacking apparatus which creates positive stability in the stack of articles as the articles accumulate.

It is also an object of the present invention to provide an article stacking apparatus which has provisions for maintaining uniform stacking dynamics as the articles accumulate.

It is also an object of the present invention to provide an article stacking apparatus which is capable of producing a stable stack of comparatively great height.

It is also an object of the present invention to provide an article stacking apparatus which has provisions for rapid removal of a full stack from the stacking apparatus.

The present invention provides an article stacking apparatus which includes means for impacting with moving articles which are to be stacked. The impact means has an inclined slide and the article stacking apparatus also has means located adjacent to the lower end portion of the slide surface for receiving articles which have impacted with the impacting means.

BRIEF DESCRIPTION OF THE DRAWINGS

The invention will be hereinafter more fully described with reference to the accompanying drawings in which.

FIG: 1 is a perspective view of the article stacking apparatus of the present invention.

DETAILED DESCRIPTION OF THE PREFERRED EMBODIMENT

Figure 1:
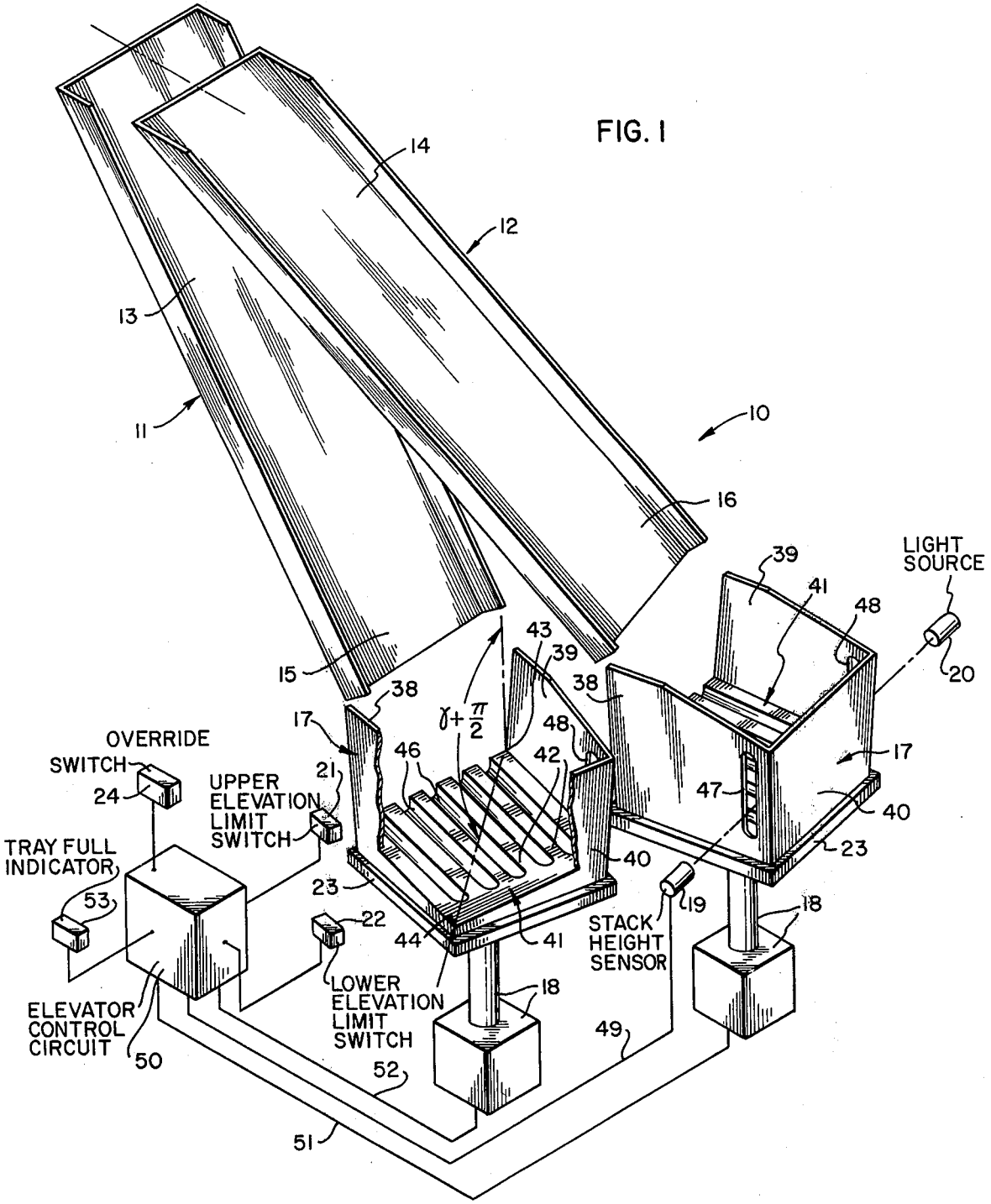

As illustrated in FIGS. 1 through 4, the article stacking apparatus invention which is designated generally by the number 10 has a plurality of slides 11 and 12. Each slide 11 and 12 has an upper planar portion 13 or 14 which is inclined to the horizontal and a respective lower portion 15 and 16 which twists progressively through a small angle crosswise to the principal direction of inclination. The stacking apparatus 10 also has a plurality of containers or collector trays 17, one of which is located at the lower end of each of the slides 11 and 12 and a plurality of elevators 18, one for each tray 17, which position and maintain the tray at the proper height for optimum stacking dynamics relative to article trajectory from the appropriate slide to the tray. A photoelectric article stack height sensor 19 and a light source 20 are also provided for each tray 17 to provide a control reference for operation of the appropriate elevator 18; and an upper elevation limit switch 21 and a lower elevation limit switch 22 are provided for each tray 17 to define maximum and minimum levels for the elevator platform 23 upon which the tray rests. An override switch 24 is provided for each elevator 18 to cause the elevator to ascend directly from its lower to its upper limit. The elevators 18, the associated upper and lower limit switches 21 and 22 and the photoelectric sensor and its light source 20 for sensing the surface of the stack are in themselves known in the art and hence are not described in detail.

The article stacking apparatus 10 also includes a movable article transporter 25 which drops articles individually on a predetermined slide 11 or 12. The transporter 25 has compartments such as the compartments 26, 27 and 28 and these compartments have the respective hinged trap door floors 29, 30 and 31. Each sidewall 32, 33, 34, 35, 36 and 37 of these compartments makes substantially an angle $\alpha$ with the vertical plane and the entire transporter 25 is adapted to move in the direction indicated by the arrow along a path that will place the compartments substantially above the slides 11 and 12.

The compartmentation in the transporter 25 resembles to a degree that found in a file drawer in which many vertical separators exist, with one compartment allocated per individual article. The compartments are ordered serially with respect to the direction of motion and the compartments are located so that their major planes are substantially crosswise to the direction of motion, except for the previously mentioned angle $\alpha$. While the compartment configuration is similar to that of an LSM carrier, it is generally larger, so as to accept, for example, relatively flat articles of the size of magazines, folded newspapers, circulars, large envelopes, etc. Where loose-leaved articles such as magazines and similar documents are processed, their single bound edges will initially rest on the compartment trap door and will subsequently lead article motion in all dynamic phases of the stacking operation. This provision will preclude the possibility of leaf flutter leading to jamming, disruption of stacking, or article damage.

As illustrated in FIG. 1, each collector tray 17 is a foursided, box-like container which is open at the top and has walls 38, 39 and 40 on three sides. Each collector tray 17 also has a rectangular-shaped base 41 whose grooved interior floor surface 42 defines an overall flat bearing surface for the stack of articles. The interior floor surface 42 slopes relative to the exterior underside of the tray base 41 which rests on the elevator platform 23. Consequently when the tray 17 stands in its normal upright configuration on its base, the interior floor surface 42 is sloped in a direction which is substantially at a diagonal relative to the rectangular base outline. As illustrated, the angle of the slope is substantially ( $\gamma + \pi/2$) from the vertical (or $\gamma$ from the horizontal) in a direction which runs substantially from a corner 43 at the open side down to a low point at the diagonally opposite corner 44. This slope causes successive articles of the stack during buildup to rest against the two adjacent walls 38 and 40 on the downward sides of the sloping floor surface 42, thereby to achieve positive stack stability regardless of the height of the stack.

This provision for a flush, dihedral condition on two adjacent faces of the stack simultaneously guarantees a controllable location, as well as orientation, for each article within its nominal plane in a stack. This is particularly significant in the case of a random population of flat articles whose principal dimensions of length and width vary widely. The benefits obtained from such an oriented stack relate to enhancement of subsequent automated pick-up and removal of articles, one-by-one, from the stack, by means known in the art which are not shown since it does not form part of this invention, that require a predictable location for each article.

Figure 2:
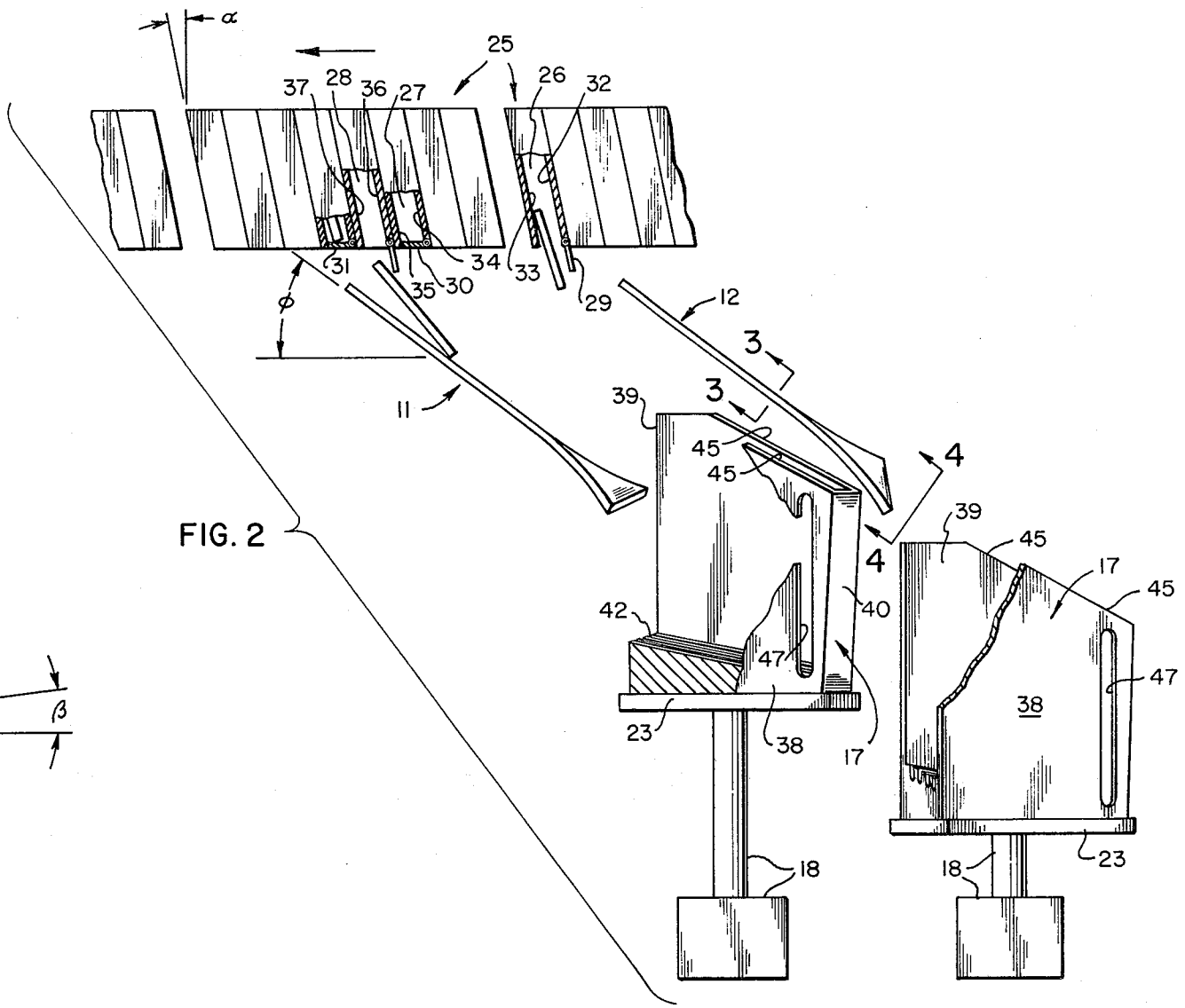
FIG. 2 is a side elevational view of the structure illustrated in FIG. 1 but also showing a transporter tthat forms part of the prsent invention.

The three walls 38, 39 and 40 of the collector tray 17 are sloped slightly outward, from the vertical in such a manner that the resulting internal draft angle permits stacking of the trays for storage when they are empty or otherwise not in use. As illustrated in FIG. 2, the side walls 38 and 39 which must guide the articles during free fall have sloped upper edges 45 to clear the slide, such as the slide 12, above them.

As best illustrated in FIG. 1, the interior floor 42 contains several deep, parallel grooves 46. The purpose of the grooves 46 is to accommodate a stack retrieval fixture that is shaped in the form of a fork. The tines of such a fork, which is not a part of the subject invention and is not shown herein, would be sized to be inserted from the open side of the tray below the stack surface, and thereby nest entirely in the grooves, to permit the entire stack of articles to be subsequently raised out of the tray on the fork.

As illustrated in FIGS. 1 and 2, in order to provide for sensing the location of the top surface of the accumulating stack of articles substantially vertical slots 47 and 48 are provided in the respective side walls 38 and 39 of the tray 17. These slots 47 and 48 are located parallel and opposite to each other, near the intersecting corners with the third or rearward tray wall 40. These slots 47 and 48, as illustrated in FIG. 1, provide optical line-of-sight access across the interior of the tray by the photoelectric height sensor 19 and its light source 20.

The signal from the sensor 19 is transmitted on the lead 49 to an elevator controlcircuit 50 which generates an output on the lead 51 to control the appropriate elevator 18. A similar signal would also be transmitted on the lead 52 to the other elevator 18. However, the sensor 19 and its light source associated with that elevator have been omitted for clarity. A tray full indicator 53 for providing an indication when a tray 17 is full of articles is also connected to the elevator control circuit 50.

Figure 3:
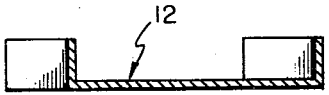
FIG. 3 is a sectional view of the slide which forms part of the invention taken on the line 3—3 in FIG. 2.
Figure 4:
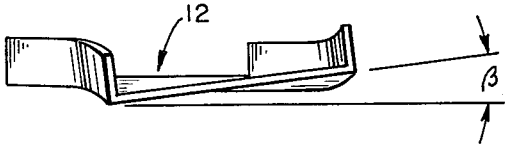
FIG. 4 is a sectional view of the slide taken on the line 4—4 in FIG. 2.

As illustrated in FIG. 1 the slides 11 and 12 are skewed or have their end portions pointed to the alternate sides of the transporter 25. This achieves a "herringbone"-like configuration for many successive slides and thereby results in a high slide density per unit length of the transporter 25. This is achieved by staggering the locations of successive stacks along two rows parallel to, and on opposite sides of, the transporter path. This permits the chute pitch to be half that for the case where the stacks are arranged in a single row. It will, of course, be appreciated that this feature is optional and that a single row of stacks can be used. The geometry of the slide surface itself is best described in terms of (1) its centerline or a line of its surface midway between its sides, and (2) the cross-sections of the slide, perpendicular to the centerline, taken at the location indicated by the lines 3—3 and 4—4 illustrated in FIG. 2 which are shown in FIGS. 3 and 4. As illustrated in FIG. 2, the angle of the centerline with the horizontal is $\phi$. As illustrated in FIG. 3 all slide cross-sections down to the location of section 3—3, which occurs just below all impact points for articles which dropped from the transporter 25 are parallel to the horizontal. However, as illustrated in FIG. 4, beginning at a point just below the location of section 3—3 and proceeding down to the location of section 4—4, the slide cross-section twists uniformly and progressively through an angle $\beta$, or so that the bottom of the slide makes an angle $\beta$ with the horizontal at the end of the slide.

Figure 5:
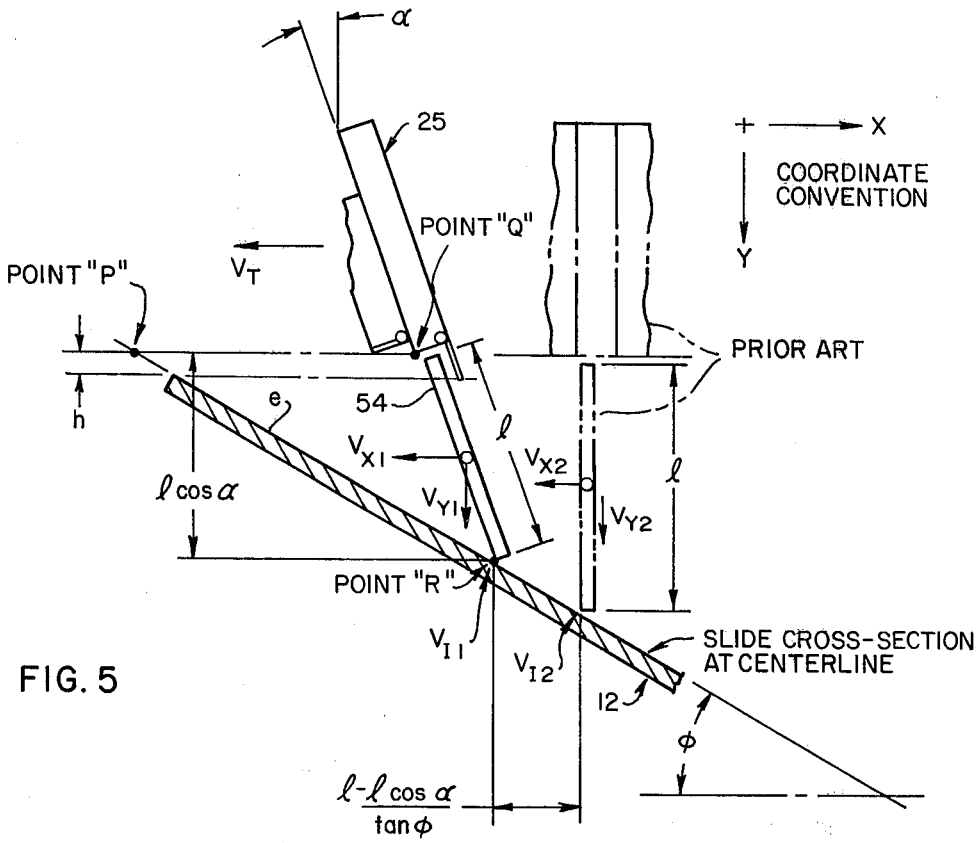
FIG. 5 is a schematic diagram of the parameters associated with the upper portion of the slide of the article stacking apparatus illustrated in FIG. 2.

As illustrated in FIG. 5, an article 54 exiting through the bottom opening of a compartment of the transporter 25 would not drop vertically but would rather slide out, along the plane of the compartment cant and, hence, with an acceleration vector component relatively opposite to that of the carrier motion. With appropriate values for the cant angle from the vertical $\alpha$, the length of the article l, and its coefficient of friction $f_c$ with the wall of the compartment, the net horizontal velocity change may attain the same absolute magnitude, but of opposite sense, as that of the transporter 25. At this instance, the absolute motion of the article in the line of transporter motion is zero. If this instant coincides with that when the article 54 just clears the compartment, then all accelerative forces in the line of transporter 25 motion will cease, and the article will drop vertically until impact with the chute. The attitude of the article during this final phase will be at an angle $\alpha$ with the vertical, or somewhat less, depending on rotation experienced by the article due to gravity during progressive emergence from the compartment.

The following series of dynamic equations describe this case:

$$-V_T = V_{A-X} \quad (1)$$

$$= V_A \sin\alpha \quad (2)$$

$$= \sqrt{2aS} \cdot (\sin\alpha) \quad (3)$$

$$= \sqrt{2al} \cdot (\sin\alpha) \quad (4)$$

$$= \sqrt{2g(\cos\alpha - f_c \sin\alpha)l} \cdot (\sin\alpha) \quad (5)$$

The symbols in the above equations are defined as follows:

$V_T$ The forward velocity of the transporter $V_A$ The velocity of the article relative to the transporter in the plane of the canted compartment $\alpha$ at the instant of the final exit $V_{A-X}$ The horizontal velocity component $V_A$ $a$ The acceleration on the article while in the compartment, measured parallel to the sliding plane $f_c$ The coefficient of friction between the article and the compartment wall $S$ The distance the article has slid in the $\alpha$ plane from its initial, or rest, position $l$ The length of the article, i.e., its dimension as measured parallel to the canted profile of the compartment. At the instant of exit, $S_2 = l$ $g$ Acceleration due to gravity (386 in/sec$^2$ = 32.2 ft/sec$^2$)

Trigonometric manipulation of above equation (5) yields an equation in the form:

$$\sin^6\alpha - \left[\frac{1}{f_c^2+1}\right] \cdot \sin^4\alpha + \left[\frac{V_T^2 f_c}{gl(f_c^2+1)}\right] \cdot \sin^3\alpha + \frac{V_T^4}{4g^2l^2(f_c^2+1)} = 0 \quad (6)$$

When the values for previously defined symbols $f_c$, l, and $V_T$ are specified and the value for g is introduced, then this equation (6) can be solved manually for $\alpha$ by means of synthetic algebraic division, or other algebraic means well known to the art, embracing standard computer programs. This solution will yield up to five extraneous roots, or non-applicable values, which result, as it is well known, from the algebraic manipulations (involving squaring) of the previous equation (5) to reach the present form in equation (6). The extraneous values can be identified by successively substituting each root obtained into the previous equation (5). The root for which equation (5) is found valid is the required value for $\alpha$.

This demonstrates that, given a population of articles with length l and frictional coefficient $f_c$, then there exists for a specified transport velocity $V_T$ a unique compartment cant angle $\alpha$, for which the net forward velocity of the article at the time of final exit can be entirely eliminated. Having established this fact, it is now possible to proceed to the demonstration of a more general hypothesis associated with velocity compensation, namely, that for a unique set of values for l, $f_c$, $\phi$, $V_T$, together with the corresponding dictated value for $\alpha$ by equation (6), the impact velocity of the article with the slide $V_{I1}$ will be less than that for the case where $\alpha$ is zero, $V_{I2}$, which is the case defining the state-of-the-art systems. These two cases are presented side by side in FIG. 5, wherein it is assumed that the vertical distance between the transport and distribution compartment and the slide corresponds to simultaneity of the following events: (1) final emergence from the compartment, and (2) impact with the slide. In terms of the hypothesis concerning impact velocities in the two cases, it will therefore, be necessary to show, using the nomenclature shown in FIG. 5, that $$V_{I2} - V_{I1} \geqslant o \tag{7}$$

This expresses impact velocity in terms of the terminal velocity component normal to the slide plane in each case. As shown in FIG. 5, the difference between impact velocities becomes:

$$V_{I2} - V_{I1} = [V_{X2} \sin \phi + V_{Y2} \cos \phi] - [V_{X1} \sin \phi + V_{Y1} \cos \phi] \tag{8}$$

By definition, $$V_{X1} = V_T - V_{AX} \tag{9}$$

$$= O \tag{10}$$

Thus, the above equation (8) reduces to $$V_{I2} - V_{I1} = V_{X2} \sin \phi + V_{Y2} \cos \phi - V_{Y1} \cos \phi \tag{11}$$

Since $$V_{Y2} = \sqrt{2\,g\,l} \tag{12}$$

and since $$V_{Y1} = \sqrt{2\,g\,l} \cdot \sqrt{\cos \alpha - f_c \sin \alpha} \cdot \cos \alpha \tag{13}$$

and since finally, $$V_{X2} = V_T \tag{14}$$

the equation (11) can re re-expressed in the form $$V_{I2} - V_{I1} = V_T \sin \phi + \cos \phi \sqrt{2\,g\,l}\,[1 - \sqrt{\cos \alpha - f_c \sin \alpha} \cdot \cos \alpha] \tag{15}$$

Inspection of the above equations (13) and (15) shows that the former will have a maximum value, and hence that the latter will have a minimum value, for $f_c = 0$. That is, the maximum vertical velocity and, hence, the maximum impact velocity for Case 1 will then occur, corresponding to which the above equation (15) becomes, $$V_{I2} - V_{I2} = V_T \sin \phi + \cos \phi \sqrt{2\,g\,l}\,[1 - \cos \alpha^{n/2}] \tag{16}$$

Noting the trigonometric fact that when $n > o$, $$\cos \alpha^n < 1 \tag{17}$$

Hence, the bracketed factor in the second right hand term in the above equation (16) must be positive. Furthermore, by the convention established in originally defining the equation (8) relative to establishing the sense of a "positive" impact, $$\cos \phi > 0 \tag{18}$$

$$\sqrt{2\,g\,l} = V_{Y2} > 0 \tag{19}$$

$$V_T > 0 \tag{20}$$

$$\sin \phi > 0 \tag{21}$$

On the basis of equations (16) through (19), the second right hand term in equation (15) must be positive. Furthermore, equations (20) and (21) require that the first right hand term in equation (15) be positive. Hence, it is thereby shown that $$V_{I2} - V_{I1} > 0, \tag{22}$$

proving for the most critical case, i.e., where $f_c = 0$, that the original hypothesis, as identically stated in equation (7), is true.

In the course of demonstrating the above hypothesis, an important additional fact was also demonstrated relative to the terminal vertical velocity components, $V_{Y1}$ and $V_{Y2}$, initially defined in equations (12) and (13) and subsequently isolated for direct comparison in the bracketed right hand factor in equation (15). Specifically, it was shown by equations (16) and (17) that, for the initially assumed condition of simultaneity of emergence from the compartment and contact with the slide, that $$V_{Y2} > V_{Y1} \tag{23}$$

Further examination of equations (12), (13) and (15), will show, moreover, that the arguments leading to the above equation holds for all article slide distances S where $$0 < S < l \tag{24}$$

It will be appreciated that this fact reveals a significant option relative to provision of velocity compensation for a population of articles having random lengths. It is seen from equation (3) that the horizontal velocity compensation vector $V_{A-X}$ varies as the square root of the distance travelled down the slide by the article(s). Assume that a specific distance $S_1$ is fixed for $S$, corresponding to the minimum article length, whereby $$V_{A-X} = -V_T \tag{25}$$

and that, moreover, impact with the slide occurs prior to complete exit from the compartment for all cases where $$l > S_1 \tag{26}$$

In this case, it is then necessary to demonstrate, by mathematical means well known to the art in differential equations, that clearance exists between the thickness of the article and the compartment clear space to insure that ultimate exit occurs without binding of the article while it is in simultaneous sliding contact with both the compartment and with the slide. Given values for slide angle $\phi$, frictional coefficient $f_c$; article thickness; compartment opening dimension; and transport velocity, this analysis will lead to definition of a maximum article length, $l_{max}$, that can be accommodated. To put this another way, an article population can now be accommodated where lengths vary from $S_1$ to $l_{max}$. To increase the upper limit of this range, one of the "fixed" values above must be changed accordingly; i.e., $V_T$ must be reduced, the compartment opening must be increased etc.

The objectives in permitting article impact involving long article lengths to occur prior to complete emergence from the compartment are twofold. The first objective is to eliminate the dispersion of article impact points associated with variable free fall trajectories and, hence, obtain the shortest possible slide length. The second objective is to reduce the vertical impact vector between the article and the slide by virtue of minimizing the drop height. This is seen to be feasible since the limiting constraint is now associated with the pre-determined slide distance $S_1$, rather than the maximum article length, $l_{max}$.

Figure 6:
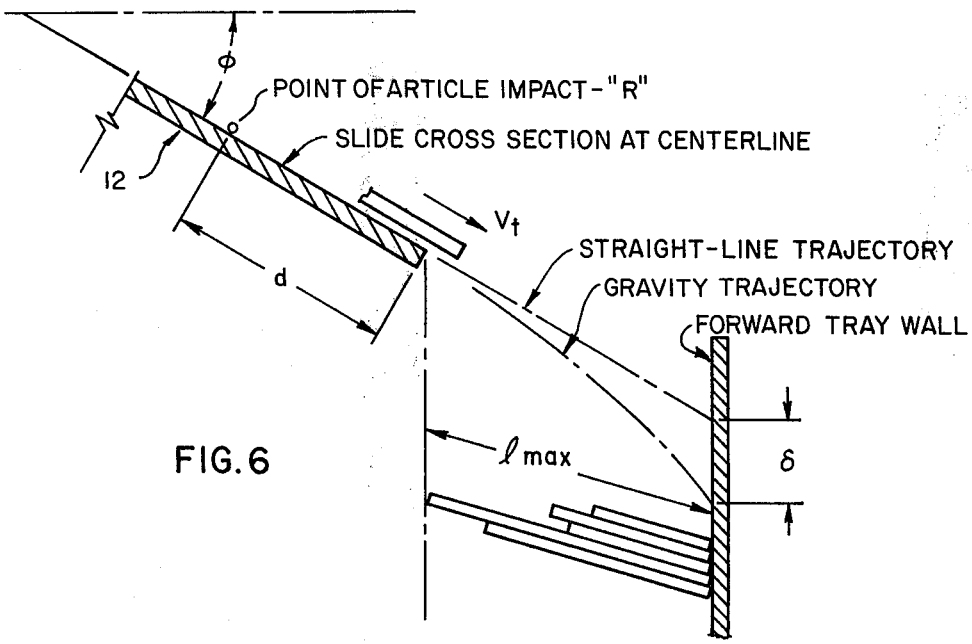
FIG. 6 is a schematic diagram of the parameters associated with the lower portion of the slide of the article stacking apparatus illustrated in FIG. 2.

Each slide, as noted previously, is an inclined, partially twisted surface with a principal inclination to the horizontal of Its sides, as illustrated in FIG. 1, are bounded by short, upright walls, somewhat as on a childrens' playground slide, to guide a descending article into the collector tray 17. (These sides are omitted from FIGS. 2, 5 and 6 for the sake of clarity). The slides 11 and 12 are supported by structure of a conventional design, known to the art, which has been omitted from the drawings for clarity. The maximum angle of crosswise tilt $\beta$, located at its lower end of each slide 11 and 12 is small and is substantially 10°. The purpose of the tilt, as indicated in FIG. 6, is to guide articles descending off the slide to impact the tray wall at approximately the same point relative to one corner of the stack. The reasons involved will be identified subsequently.

The minimum profile slope angle of the slide with the horizontal $\phi$ will be governed by the minimum gravity vector required to maintain motion of the article after impact with the slide 11 or 12. This depends on the coefficient of kinetic friction between the slide and the articles, which in turn involves the slide surface material, as well as that of the articles. By standard physics theory, for a given expected frictional coefficient $f_s$, it is necessary that $$\phi \geqslant \tan^{-1} f_s \tag{27}$$

where $\phi$ is the angle said slide surface makes with the horizontal plane and $f_s$ is the anticipated coefficient of dynamic friction between the articles to be stacked and said slide surface. The width of the slide is established by the maximum corresponding article dimension, plus a nominal allowance for clearance. An additional slide parameter is its length. The slide length m can be considered to be divided in two parts: (1) $e$, that portion above the point of article impact, and (2) $d$, that below the point of impact. The maximum length of the upper portion $e$, illustrated in FIG. 5 is defined by the expression $$e = \frac{\cos \alpha}{\sin \phi} \cdot l - \frac{h}{\sin \phi} \tag{28}$$

The first term of the right hand side of equation (28) is the trigonometric solution for PR in the triangle PQR by the law of sines, where $$PR = \frac{\sin (\pi/2 + \alpha)}{\sin \phi} \cdot QR \tag{29}$$

$$= \frac{\cos \alpha}{\sin \phi} \cdot l \tag{30}$$

The second term in equation (28) defines the clearance required for the vertical protrusion $h$, of the tray doors in the transport and distribution compartments below the lower extremity of the compartment surface in contact with the article.

The role of the lower portion of the slide $d$, is associated with the required terminal velocity of an article as it leaves the lower end of the slide. This relationship is defined by $$V_t = V_i + \sqrt{2\, g\, (\sin \phi - f_s \cos \phi)} \cdot \sqrt{d} \tag{31}$$

or $$d = \frac{(V_t - V_i)^2}{2\, g\, (\sin \phi - f_s \cos \phi)} \tag{32}$$

where, in addition to g, $\phi$ and $f_s$ defined above the other symbols have the following definitions:

$V_t$ Terminal article velocity, measured in plane of slide
$V_i$ Initial article velocity, measured in plane of slide immediately after initial impact
d Length of slide measured from point of impact to lower end It will be noted that in the originally defined case for transfer of an article from a transport compartment to the slide, the horizontal component of impact velocity is zero (equations 9 and 10) while the vertical component is, repeating equation (13) here, $$V_{Yi} = \sqrt{2\, g\, l} \cdot \sqrt{\cos \alpha - f_c \sin \alpha} \cdot \cos \alpha \tag{33}$$

The component of this velocity vector parallel to the slide plane is, therefore, $$V_{Yi} \sin\phi = \sqrt{2\, g\, l} \cdot \sqrt{\cos \alpha - f_c \sin \alpha} \cdot \cos \alpha \sin \phi \tag{34}$$

Ignoring impact energy losses, $$V_i = V_{Yi} \tag{35}$$

It is therefore, possible to re-express equation (32) in the form:

$$d = \frac{(V_t - \sqrt{2\, g\, l} \cdot \sqrt{\cos \alpha - f_c \sin \alpha} \cdot \cos \alpha \sin \phi)^2}{2\, g\, (\sin \phi - f_s \cos \phi)} \tag{36}$$

After impact with the slide, an article must achieve, by the time it reaches the end of the slide, the velocity which will produce the necessary stacking trajectory. The criterion here is that the leading edge of each article contact the forward collector tray wall prior to contacting the top surface of the stack (FIG. 6). This provision will preclude the possibility of impact with the aft edges of previously arriving articles near the top of the stack, thereby disheveling these articles and compromising proper stacking dynamics of subsequently arriving articles. Achievement of this criterion is simultaneously a function of (1) the articles' terminal velocity vector $V_t$; (2) the vertical distance between the extended plane of the slide and the top of the stack, measured at the forward wall of the tray; and (3) the horizontal displacement between the lower edge of the slide and the collector tray's forward wall.

The third listed parameter is essentially equal to or slightly greater than the maximum length $l_{max}$ of the article population to be stacked, since the article should be clear of the slide by the time it impacts with the tray. This leaves parameters (1) and (2) above as the controllable variables in achieving the required dynamics of stacking. The greater the terminal velocity vector $V_t$, the less the above defined vertical displacement parameter need be, since the elapsed time prior to impact will be less, and the article will have correspondingly less time to fall vertically in this time. In this context, the tradeoff involved, is one between (1) increasing the length of the portion of slide that governs terminal velocity $V_t$ according to equation 31, and (2) lowering the stack surface relative to the slide to permit greater vertical drop distance $\delta$ to the stack from a hypothetical straight line trajectory at angle $\phi$ (see FIG. 6). Generally speaking, minimizing this drop height, defined by a relatively flat article trajectory, will maintain optimum stability of the article in free fall relative to flutter and sailing; and it is, therefore, desirable to provide the article with sufficient terminal velocity to achieve this condition.

Because this condition may be significantly influenced by the aerodynamic response of some thin articles, involving such parameters as, stiffness, weight and edge condition, experimental verification of the value chosen for $\delta$ is desirable. Once $\delta$ is then specified, the required value for $V_t$ may be determined in the same experiments or else by methods known to the art of differential equations. This value may be then introduced into equation 36, the expression previously derived for the length of slide downstream of the point of impact. With the value for $V_t$ in view of the foregoing, it is apparent from equations (28) and (36) that the entire length of the slide, $m$, is determined substantially according to the formula $$m = e + d = \left[\frac{\cos\alpha}{\sin\phi} l - \frac{h}{\sin\phi}\right] + \frac{(V_t - \sqrt{2gl} \cdot \sqrt{\cos\alpha - f_c \sin\alpha} \cdot \cos\alpha \cdot \sin\phi)^2}{2g(\sin\phi - f_s \cos\phi)} \quad (37)$$

In order to use the article stacking apparatus 10, the elevators 18 would be placed in their up or unloaded positions through the use of the manual override switch 24 and a tray 17 would then be placed upon each elevator platform 23. The article transporter 25, with its compartments full of articles to be stacked, would then be placed in motion by suitable means known in the art and would be directed in a path that would take it over the upper end portions 13 and 14 of the respective slides 11 and 12. At an appropriate location the trap doors, such as the door 29 illustrated in FIG. 2, would be opened by means known in the art and the article in the compartment associated with that trap door would then drop away from the transporter 25 and strike the appropriate slide 11 or 12. From there the article would slide along the slide and pass into the appropriate tray where it would become part of a stack of articles in the manner previously described.

In order to control the incremental descent of the elevator 18 the location of the top of the stack is sensed optically by a photo sensor beam from the light source 20 which penetrates the tray 17 through the pair of previously described slots. When the sensor beam is unbroken, the elevator 18 is inoperative. When the beam is broken by the presence of a newly arrived article, the elevator 18 is caused to be lowered by the elevator control 50 until the beam is again clear. As previously indicated the initial position of the elevator 18, when the tray 17 is empty, is at maximum travel height, at which point the sensor beam is slightly above the level of the tray's interior floor surface 42, as viewed through the pair of slots in the walls. As a stack begins to form, causing the beam to be blocked, the signal created thereby from the sensor 19 actuates the elevator drive, causing it to lower the elevator until the beam is again clear.

When the stack height reaches very nearly to the top of the collector tray walls, the elevator 18 will have descended to a point where a lower elevator limit switch 22 is activated. This event prevents further descent of the elevator 18 through means well known to the art. This switch 22 at the time may also be used to activate the visual or audial "tray full" indicator 53 alerting personnel to replace the full tray 17 with an empty one. The limit switch signal may also be communicated to the transport control system, to inhibit further article drops at the slide where the full tray condition exists until the tray replacement is made. The electrical control circuits used in all cases involve means known in the art.

Finally, when the tray 17 has been replaced, activation of the manual override switch by personnel causes the elevator 18 to re-ascend to a point where the upper limit switch 21 halts further travel. Actuation of the manual switch also terminates the personnel indicator signal described above. The upper limit position corresponds to the earlier defined "initial" position, where the sensor beam is just above the interior floor of the tray 17. Activation of the upper limit switch 21 simultaneously removes any inhibit override to the transport system identified above, and article drops to the slides 12 and 13 immediately resume.

It will be observed that removal of the stack of articles in a tray 17, followed by introduction of any empty tray 17 involves a relatively rapid operation, compared to the case where no collector tray is used, and only the articles themselves are removed. In the former case the stability of the stack is maintained during removal of the tray and during all subsequent transporting and handling of the tray while in its upright condition. When only the stack itself is removed, maintaining its original stability and coherency, particularly where a population of random-sized articles are involved, is uncertain. Not only is there higher risk of stack dishevelment and dropping and damage of articles, but the care and time required of personnel to avoid these events are thereby increased.

It will be appreciated that the elevator control logic described here is illustrative of many possible procedures that may be adopted for operation of the basic configuration. In particular, the manual tray replacement procedure hypothesized here can be readily abandoned in favor of a completely automated system, since the associated mechanisms to perform this role are within the state-of-the-art.

Although the invention has been described in considerable detail with reference to a preferred embodiment, it will be understood and appreciated that variations may be made within the spirit and scope of the invention as defined in the appended claims.

What is claimed is:

1. Article stacking apparatus comprising means for impacting with moving articles which are to be stacked, said impact means having an inclined surface with a lower end portion, means located adjacent to the lower end portion of said slide surface for receiving articles which have impacted with said impacting means and article transport means for transporting the articles which are to be stacked over said impact means, said article transport means having inclined walls upon which the articles are adopted to rest and wherein the angle $\alpha$ that the surface of the walls upon which the articles are adapted to rest makes with the vertical plane is implicity determined substantially from the following equation, $$\sin^6\alpha - \left[\frac{1}{f_c^2+1}\right] \cdot \sin^4\alpha + \left[\frac{V_T^2 f_c}{gl(f_c^2+1)}\right] \cdot \sin^3\alpha + \frac{V_T^4}{4g^2l^2(f_c^2+1)} = 0$$

where the specific value for $\alpha$, of six possible roots, is determined by selecting the one value which substantially satisfies the following equation, $$V_T = \sqrt{2gl(\cos\alpha - f_c \sin\alpha)} \cdot \sin\alpha$$

where l is the dimension of the article measured in a substantially vertical direction with the article in its expected position resting against the surface of said wall, $f_c$ is the expected dynamic coefficient of friction between the article and said inclined wall slide surface, g is the acceleration due to gravity, and $V_T$ is the expected forward velocity of said transport means.

2. Article stacking apparatus comprising means for impacting with moving articles which are to be stacked, said impact means having an inclined surface with a lower end portion and means located adjacent to the lower end portion of said slide surface for receiving articles which have impacted with said impacting means, said article receiving means comprising a container with a bottom portion and an open top portion, said container having an inclined inner bottom surface inclined downward substantially toward one inner corner of said container and having at least two sides which slope in an outward direction from the bottom portion to the top portion of said container.

3. The article stacking apparatus of claim 2 wherein said container has an opening in at least one wall thereof and further comprising means for detecting the level of stacked articles through the opening in the wall of said container.

4. The article stacking apparatus of claim 3 further comprising means for adjusting the vertical position of said container in response to said level detecting means.

* * * * *